United States Patent [19]

Morris

[11] Patent Number: 5,007,322

[45] Date of Patent: Apr. 16, 1991

[54] PERCUSSION IMPLEMENT HANDLE

[76] Inventor: Farrell Morris, 726 Vosswood Dr., Nashville, Tenn. 37205

[21] Appl. No.: 460,503

[22] Filed: Jan. 3, 1990

[51] Int. Cl.[5] ..... G10G 5/00

[52] U.S. Cl. ..... 84/453; 84/421; 84/422.4

[58] Field of Search ..... 84/402, 453, 422.4, 84/421, 422.1, 422.2, 422.3

[56] References Cited

U.S. PATENT DOCUMENTS

| | | | |
|---|---|---|---|
| 1,761,245 | 6/1930 | Vitto | 84/422.4 |
| 2,417,972 | 3/1947 | D'Arcy | 84/422.3 |
| 2,616,218 | 11/1952 | Brown | 84/402 X |
| 4,127,053 | 11/1978 | Cohen | 84/402 |
| 4,315,453 | 2/1982 | Gabor et al. | 84/422.3 |
| 4,658,694 | 4/1987 | Marks | 84/402 X |

*Primary Examiner*—Lawrence R. Franklin
*Attorney, Agent, or Firm*—Mark J. Patterson

[57] ABSTRACT

A percussion power handle is disclosed that allows a user to grasp plural percussion implements in each hand. The device comprises plural grips interconnected by a frame. Each grip releasably receives a percussion implement. A frame biases grips away from each other.

5 Claims, 2 Drawing Sheets

PERCUSSION IMPLEMENT HANDLE

BACKGROUND OF THE INVENTION

The present invention relates generally to a handle for percussion implements and more particularly to a device for firmly and effectively holding plural percussion implements in each hand.

It will be appreciated by those skilled in the art that percussion musicians desire the ability to easily create a variety of sounds and rhythms. To this end, a number of different percussion instruments and implements have been developed. For example, a snare drum has been made to sound differently than a bass drum. Also a drumstick contacting a snare drum is designed to sound differently than a wire brush contacting the same snare drum.

At times, percussion musicians desire different sounds from one beat to the next. However, because musicians have, at most, two hands, the musician is limited to two implements. Further, at times, percussion musicians desire to play plural "notes" simultaneously. When a percussion musician uses plural percussion instruments in each hand, a normal person's hand size limits the effective and firm grasp of more than one implement. This occurrence is especially common when a musician attempts to use two thick drumsticks. Although one can be securely grasped between the user's thumb and index finger, the other stick cannot be firmly and effectively grasped between any of the user's remaining fingers. Although this problem is not as apparent in the operation of a xylophone or vibraphone, the problem still exists.

On a related matter, musicians desire to play different sounds while using the same implement in contact with the same instrument. An implement held firmly in a user's hand making contact with an instrument makes an entirely different sound than the same contact where the implement is loosely held. The difference in sound is caused by the dissipation of the sound into the user's hand.

What is needed, then, is a device that allows the user to firmly and effectively hold more than one percussion implement in each hand while concurrently preventing the dissipation of sound associated with a hand held implement.

Accordingly, an object of the present invention is to allow a user to firmly and effectively grasp plural percussion instruments.

A further object of the present invention is to allow a user to produce a "bigger" sound that is possible presently due to the dissipation of sound into user's hand.

SUMMARY OF THE INVENTION

In the present invention, a percussion implement handle is provided to allow the user to grasp plural percussion implements in each hand. Plural grips are joined by a bend section that biases the grips apart. Each grip grasps a percussion implement, thereby allowing user to firmly and effectively grasp plural percussion implements.

DESCRIPTION OF THE PREFERRED EMBODIMENT

Figure 1:
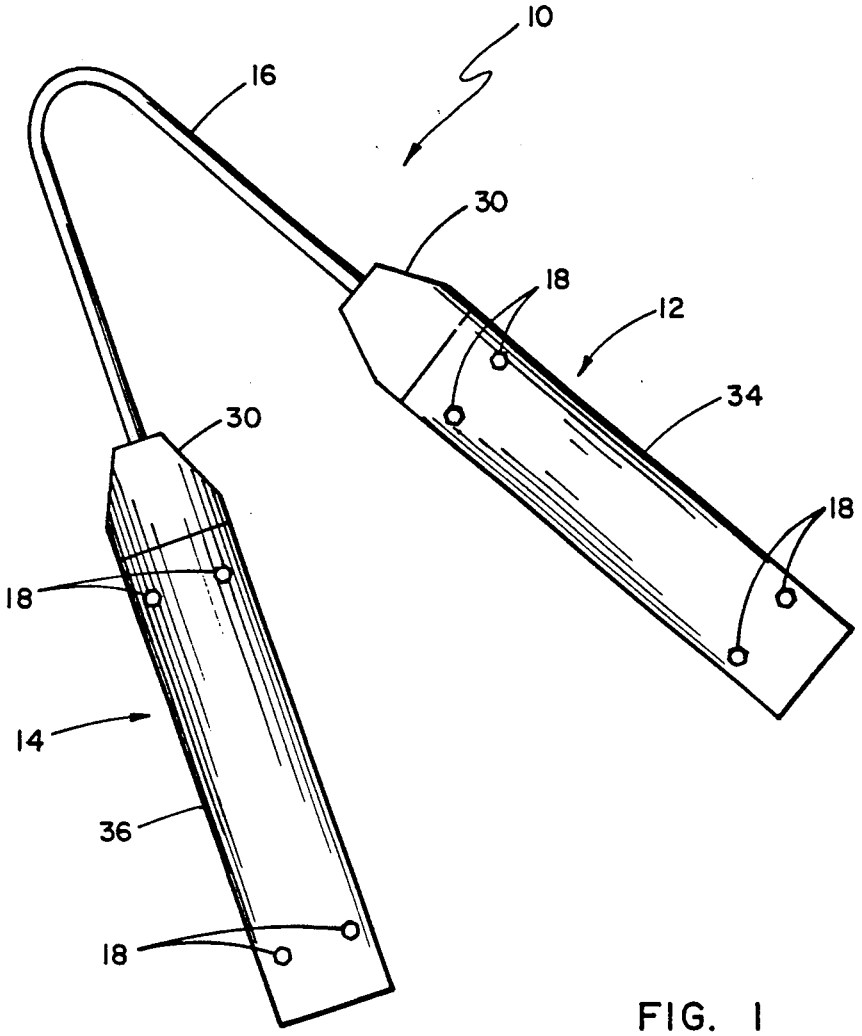
FIG. 1 is a top view of the present invention.
Figure 1A:
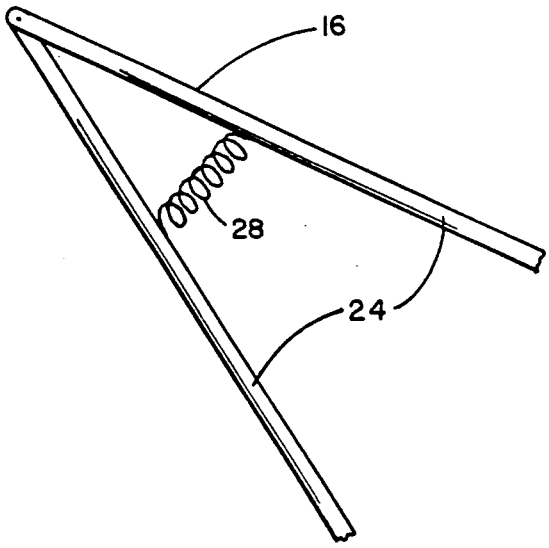
FIG. 1*a* is a partial view showing an alternate embodiment of the bend section.
Figure 2:
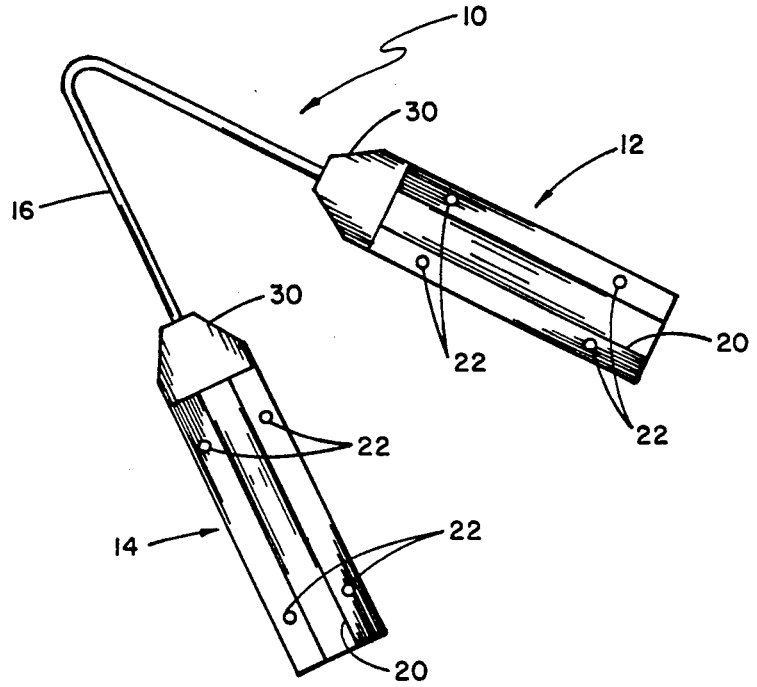
FIG. 2 is a top view of the device exposing the channel.

FIGS. 1 and 2 show generally at 10 the percussion implement handle of this invention. First grip 12 and second grip 14 are joined together by frame 16. Frame 16 is Constructed from a semi-rigid and bendable material. In the preferred embodiment, frame section 16 is constructed from a metal rod. However, as shown in FIG. 1*a*, frame 16 can also consist of elongated sections 24 hingedly attached and biased apart by use of spring 28.

In the preferred embodiment, grips 12, 14 are constructed from nylon cylinders with end 30 bevelled toward frame 16. Bevelled end 30 is not essential to the operation of device 10. However, grips 12, 14 can also be formed from wood or molded plastic cylinders or specifically molded to a form appropriate to receive both frame 16 and releasably receive a percussion implement (52 in FIG. 3). In the preferred embodiment, frame 16 is secured to wooden dowels (not shown) which are, in turn, inserted in channels 20 at bevelled ends 30. However, frame 16 can also be glued into grips 12, 14 or placed in a hole removed from grips 12, 14.

Members 34, 36 are releasably attached to grips 12, 14 to allow percussion implement handle 10 to releasably grasp percussion implement 52. In the preferred embodiment, members 34, 36 are semi-cylindrical portions removed from grips 12, 14. FIG. 2 specifically shows grips 12, 14 without members 34, 36. In the preferred embodiment, holes 22 are placed through grips 12, 14 and members 34, 36 to receive a screw, bolt or other conventional fastener to releasably attach grips 12, 14 to members 34, 36, respectively. In the preferred embodiment, screws with a hexagonal slot are used. Also, in the preferred embodiment, holes 22 are sized to receive and hold the respective hexagonally slotted screws.

Channel 20 runs axially through each grip 12, 14. Liner (42 in FIG. 3) surfacially covers the length of channel 20 in the preferred embodiment to insulate percussion implement (52 in FIG. 3) from the relatively hard and sharp grips 12, 14. In the preferred embodiment, liner (42 in FIG. 3) is held in place conventionally by a glue or other adhesive.

Figure 3:
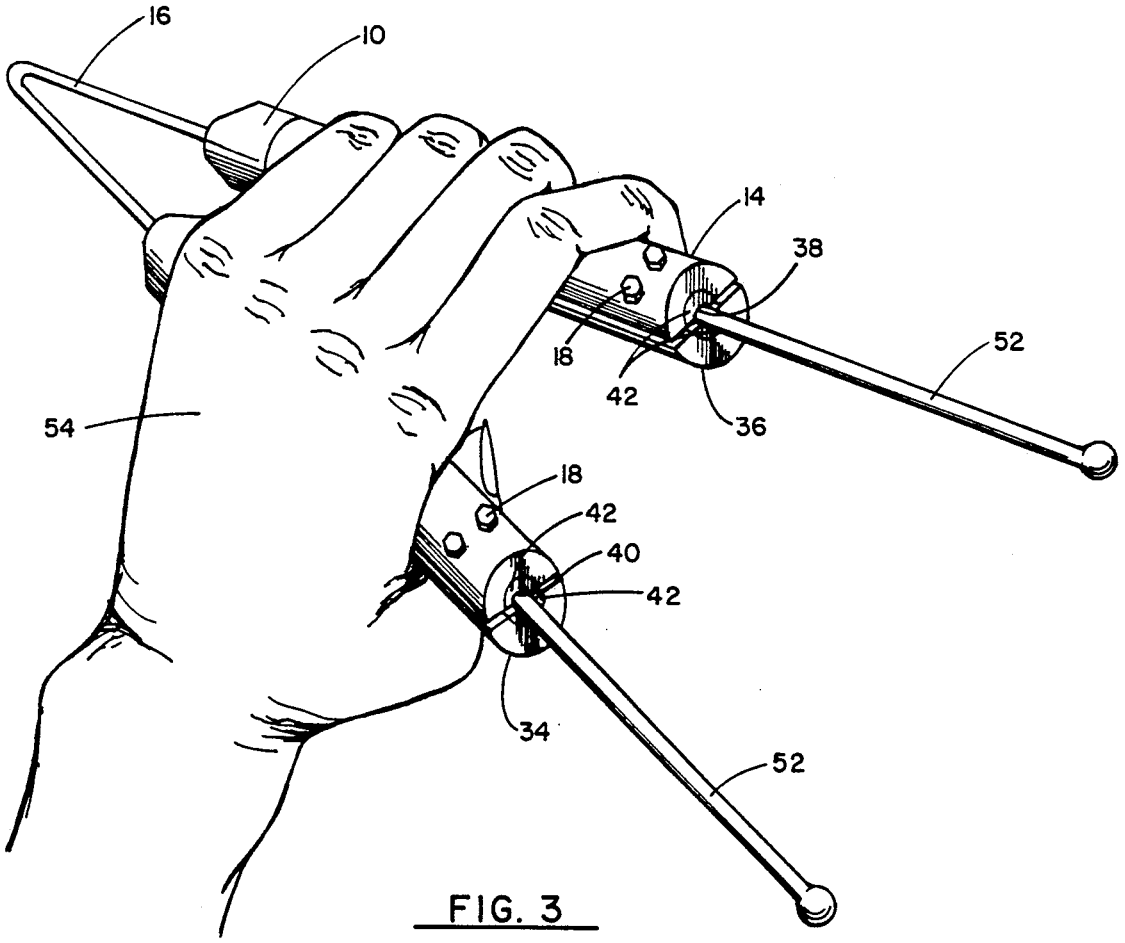
FIG. 3 shows the operation of the percussion handle in a user's hand.

FIG. 3 shows the operation of the preferred embodiment of percussion power handle 10. Screws 18 are loosened to allow orifices 38, 40 to enlarge to slidably accept percussion implement 52. Screws 18 are then tightened to decrease the size of orifices 38, 40. Liner 42 insulates percussion implement 52 from grips 12, 14.

Hand 54 partially encircles device 10 for use. After hand 54 squeezes grips 12, 14 together, bend section 16 biases grips 12, 14 apart after pressure from hand 54 is removed. In the preferred embodiment, grips 12, 14 have inside diameters of substantially 7/16" and an outside diameter of approximately 1". Grips 12, 14 are substantially $4\frac{3}{8}$" long with bevelling at end 30 covering approximately 1". End 30 is bevelled down to substantially $\frac{3}{4}$". Removed sections are approximately $3\frac{3}{8}$" long. The screw 18 used in the preferred embodiment is a socket head cup machine screw.

Thus, although there has been described to this point, particular embodiments of the present invention of a percussion power handle, it is no way intended that such specific dimensions be considered as limitations upon the scope of this invention except as set forth in the following claims.

What I claim is:

1. A new and useful percussion handle for grasping plural percussion implements comprising:

(a) means for grasping each of said percussion implements;

(b) means to bias said grasping means apart;

(c) said biasing means comprises a frame joining said grasping means;

(d) each of said grasping means comprises a handle for releasably grasping said percussion implement;

(e) said grasping means comprises a partially cylindrical handle releasably attached to a semicylindrically shaped member acting in combination to form substantially a cylinder; and (f) a channel to receive said implement formed by said connection of said handle and said section.

2. The device of claim 1 further comprising a liner surfacially covering said channel.

3. A percussion implement handle for grasping a percussion implement comprising:

(a) a first grip;

(b) a second grip;

(c) a frame connecting said grips;

(d) each of said grips including means for grasping said percussion implement;

(e) each of said grasping means comprises a member releasably attached to each of said respective grips;

(f) a channel created by the releasable connection between said grip and each respective member;

(g) a liner surfacially covering said channel; and (h) each of said respective members is a semicylindrical member releasably attached to each of said grips to form a cylinder such that said percussion implement can be placed within said channel.

4. The device of claim 3 wherein aligned holes are placed through each said grip and each said respective member to receive screws.

5. The device of claim 4 wherein each of said grips and each of said members are releasably attached by screws received by said holes.

* * * * *